US010238207B1

(12) United States Patent
Schenker et al.

(10) Patent No.: US 10,238,207 B1
(45) Date of Patent: Mar. 26, 2019

(54) ONE PIECE COLLAPSIBLE SHELVING UNIT WITH FOLDABLE UPPER AND LOWER SECTIONS AND METHOD OF USE

(71) Applicant: Advantus, Corp., Jacksonville, FL (US)

(72) Inventors: David A. Schenker, Cedarburg, WI (US); Chris Pitzo, Pewaukee, WI (US)

(73) Assignee: Advantus, Corp., Jacksonville, FL (US)

( * ) Notice: Subject to any disclaimer, the term of this patent is extended or adjusted under 35 U.S.C. 154(b) by 4 days.

(21) Appl. No.: 15/715,830

(22) Filed: Sep. 26, 2017

(51) Int. Cl.
*A47B 43/00* (2006.01)
*A47B 47/00* (2006.01)

(52) U.S. Cl.
CPC ..... *A47B 43/00* (2013.01); *A47B 47/0083* (2013.01)

(58) Field of Classification Search
CPC ... A47B 43/00; A47B 96/021; A47B 47/0058; A47B 47/0083; A47B 2220/0072; A47B 21/00; A47B 87/0215; A47B 2200/0069; A47F 5/10; A47F 3/004
USPC ..... 211/149, 188, 194
See application file for complete search history.

(56) References Cited

U.S. PATENT DOCUMENTS 915,618 A 3/1909 Mattison
1,602,410 A 10/1926 Hamblin
1,779,218 A * 10/1930 Schmalzgruber ..... A47B 53/00 312/199
2,222,318 A * 11/1940 McLauthlin ..... A47B 61/06 190/11
3,148,923 A * 9/1964 Smith ..... B25H 5/00 312/201
3,840,243 A 10/1974 Rheinhart et al.
3,977,689 A 8/1976 Rosa
4,322,005 A 3/1982 Robertson
5,592,887 A * 1/1997 Teng ..... A47B 21/00 108/134
5,882,098 A 3/1999 Brown et al.
6,145,800 A * 11/2000 Watkins ..... A47B 97/04 248/456
7,635,052 B2 * 12/2009 Ceballos-Godefroy ..... A47F 5/10 190/100
7,832,571 B2 11/2010 Felsenthal
9,144,332 B2 9/2015 Lim
9,247,809 B1 2/2016 Hsu
9,282,820 B2 3/2016 Lo
2003/0057171 A1 3/2003 Wang
2010/0213801 A1 * 8/2010 Ceballos-Godefroy ..... A47B 3/00 312/249.8

(Continued)

FOREIGN PATENT DOCUMENTS

WO WO-2007148963 A2 * 12/2007 ..... A47F 5/116

*Primary Examiner* — Ko H Chan
(74) *Attorney, Agent, or Firm* — Andrus Intellectual Property Law, LLP

(57) ABSTRACT

A shelving unit comprises a lower section movable between a first shelf-supporting condition and a first collapsed condition, and an upper section separately movable from the lower section between a second shelf-supporting condition and a second collapsed condition. The upper section is movably connected to the lower section among a first mode mounted on top of and fully engaged with the lower section, a second mode partially disengaged from the lower section and a third mode located behind the lower section.

20 Claims, 15 Drawing Sheets

(56) References Cited

U.S. PATENT DOCUMENTS

2011/0031200 A1* 2/2011 Chen ..... A47B 43/00
211/149

* cited by examiner

ONE PIECE COLLAPSIBLE SHELVING UNIT WITH FOLDABLE UPPER AND LOWER SECTIONS AND METHOD OF USE

FIELD

The present disclosure relates generally to article holding racks or shelving units and more particularly, pertains to shelving units which are pre-assembled, collapsible and utilized to support and store a variety of goods.

BACKGROUND

Article holding racks or shelving racks are commonly used by people in homes, schools and workplaces to hold various articles, such as books and magazines, plants, small appliances, knick-knacks, clothes and other personal items. Many of these units are designed to be folded or disassembled to reduce size and profile for storage. Unfortunately, many of these known units remain difficult to fold or assemble and disassemble such that storage and setup can be inconvenient. In this regard, the construction of a number of these units is rather complex, leading to increased cost of production or inconvenience to the user.

It remains desirable to provide a pre-assembled, one piece shelving unit which can be simply and quickly unfolded to a shelf-supporting condition and folded to a collapsed condition to enable ease of storage and transport.

SUMMARY

In one example, a shelving unit includes a lower section movable between a first shelf-supporting condition and a first collapsed condition, and an upper section separately movable from the lower section between a second shelf-supporting condition and a second collapsed condition. The upper section is movably connected to the lower section among a first mode mounted on top of and fully engaged with the lower section, a second mode partially disengaged from the lower section and a third mode located behind the lower section.

In a second example, a shelving unit includes a lower section having a lower rear support frame having a pair of lower vertical side members, and a set of horizontal members extending between the vertical side members. A first lower side support frame is pivotally connected to one of the lower vertical side members of the lower rear support frame. A second lower side support frame is pivotally connected to the other of the lower vertical side members of the lower rear support frame. At least one lower unit shelf is pivotally mounted to the lower rear support frame for movement between a horizontal position supported upon the first and second lower side support frames, and a vertical position removed from the first and second lower side frames. One of the first and second lower side support frames is pivoted between a first position extending forwardly from the lower rear support frame, and a second position folded parallel to the lower rear support frame and forwardly of the at least one lower unit shelf in the vertical position thereof. The other of the first and second lower side support frames is pivoted between a first position extending forwardly from the lower rear support frame, and a second position folded parallel to the lower rear support frame, and forwardly of the one of the first and second lower side support frames in the second position thereof. An upper section includes an upper rear support frame having a pair upper vertical side members, and a set of horizontal members extending between the upper vertical side members. A first upper side support frame is pivotally connected to one of the vertical side members of the upper rear support frame. A second upper side support frame is pivotally connected to the other of the upper vertical side members of the upper rear support frame. At least one upper unit shelf is pivotally connected to the upper rear support frame for movement between a horizontal position supported upon the first and second upper side support frames, and a vertical position removed from the first and second upper side support frames. One of the first and second upper side support frames is pivoted between a first position extending forwardly from the upper rear support frame, and a second position folded parallel to the upper rear support frame and forwardly of the at least one upper unit shelf in the vertical position thereof. The other of the first and second upper side support frames is pivoted between a first position extending forwardly from the upper rear support frame, and a second position folded parallel to the upper rear support frame, and forwardly of the one of the first and second upper side support frames in the second position thereof. The upper section is movably connected to the lower section among a first mode mounted on top of and fully engaged with the lower section, a second mode partially disengaged from the lower section and a third mode located behind the lower section.

In a third example, the present disclosure also relates to a method of moving a shelving unit between a shelf-supporting condition and a collapsed storage condition.

BRIEF DESCRIPTION OF THE DRAWINGS

The drawings illustrate the best mode presently contemplated of carrying out the invention.

In the drawings.

DETAILED DESCRIPTION

Figure 1:
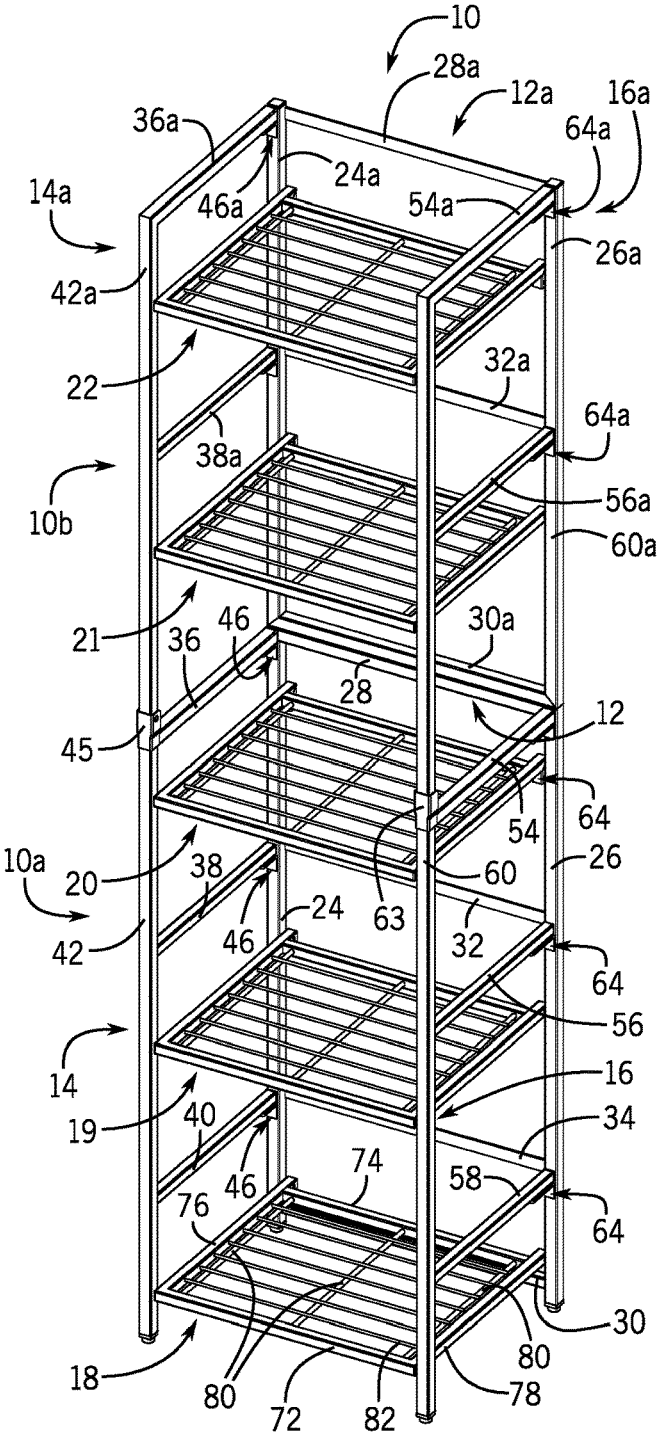
FIG. 1 is a front perspective view of a one piece collapsible shelving unit in accordance with the present disclosure and shown in an unfolded, shelf-supporting condition.
Figure 2:
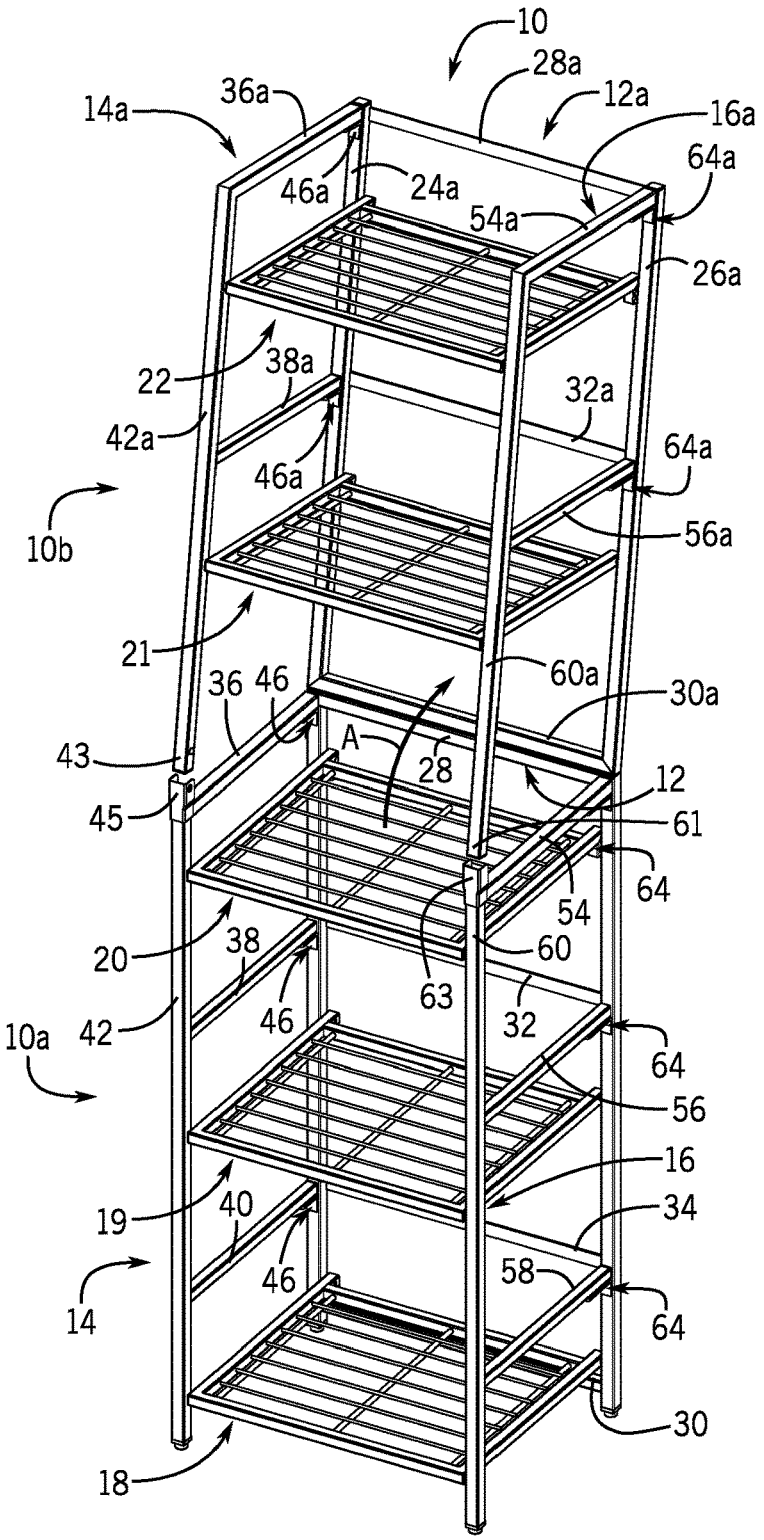
FIG. 2 is a front perspective view depicting a first stage of the shelving unit of FIG. 1 being folded towards a collapsed storage condition.

A one piece collapsible shelving unit 10 of the present disclosure is variously illustrated in FIGS. 1-22. An exemplary embodiment of the shelving unit 10 shown in FIGS. 1 and 2 is comprised of a collapsible and foldable lower section 10*a* and an upper section 10*b* which is separately collapsible and foldable about a horizontal pivot axis relative to the lower section 10*a*.

The lower section 10*a* includes a lower rear support frame 12, a movably mounted lower left side support frame 14, a movably mounted lower right side support frame 16 and a plurality of movably mounted shelves, namely, a first or lower shelf 18, a second shelf 19 and a third shelf 20.

The upper section 10*b* includes an upper rear support frame 12*a*, a movably mounted upper left side support frame 14*a*, a movably mounted upper right support frame 16*a* and a plurality of movably mounted shelves, namely, a fourth shelf 21 and a top or fifth shelf 22.

In the example illustrated, the shelving unit 10 is provided with five shelves, but it should be understood that the shelving unit 10 can be constructed with a different number of shelves in an alternate configuration contemplated by the present disclosure. As seen in the drawings, the shelving unit 10 is configurable between a shelf-supporting condition (FIG. 1) used to support and hold a variety of items, and a collapsed condition (FIGS. 19-22) which allows for convenient transport and storage of the shelving unit 10.

As seen in the drawings, the rear support frame 12 of the lower section 10*a* has a pair of opposing lower vertical side members 24, 26, respectively, and a set of four horizontal lower cross members 28, 30, 32, 34 extending between the lower vertical side members 24, 26 to provide a rigid lower rear support structure.

Figure 3:
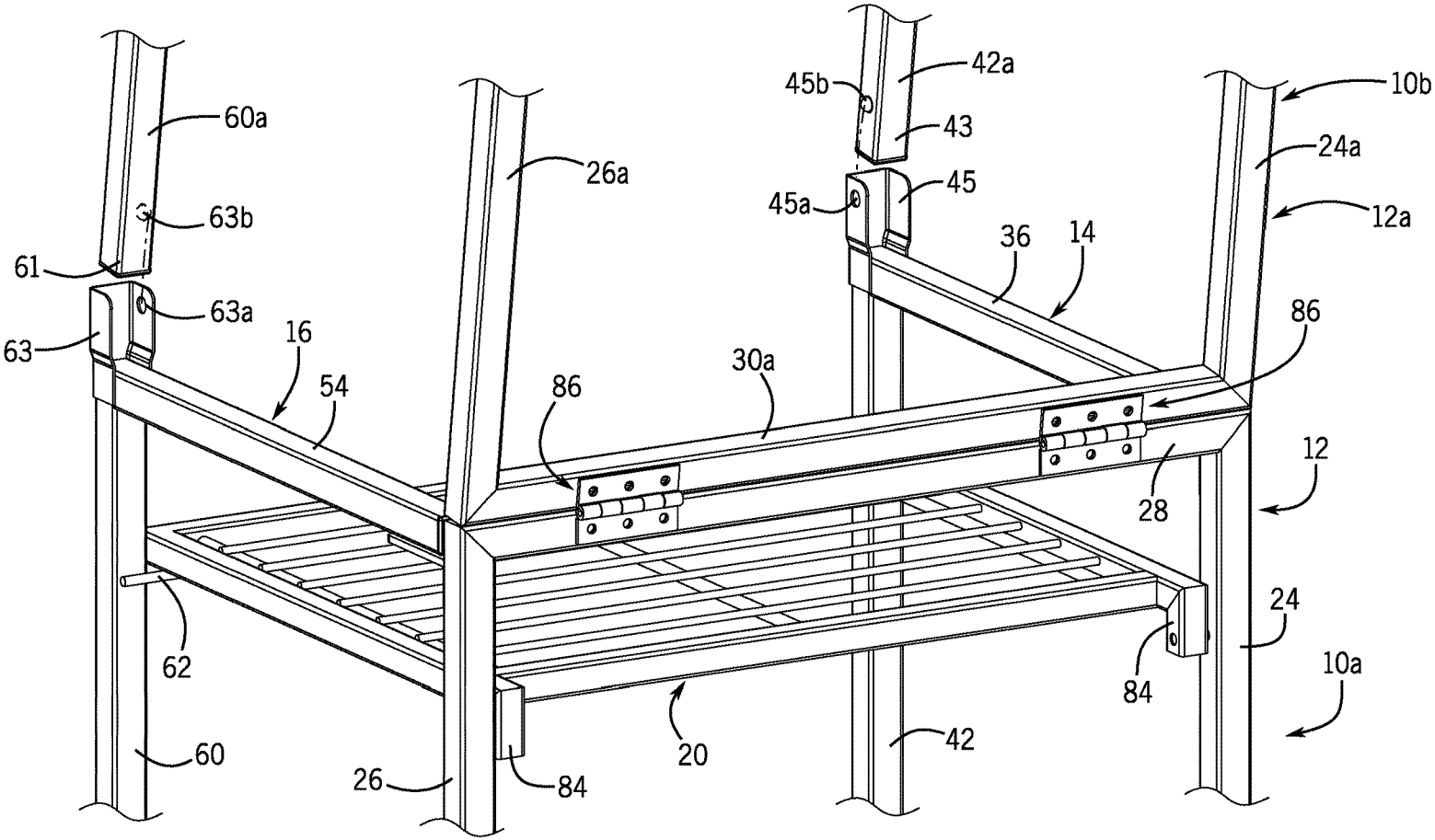
FIG. 3 is an enlarged, fragmentary rear view of the shelving unit shown in FIG. 2.
Figure 4:
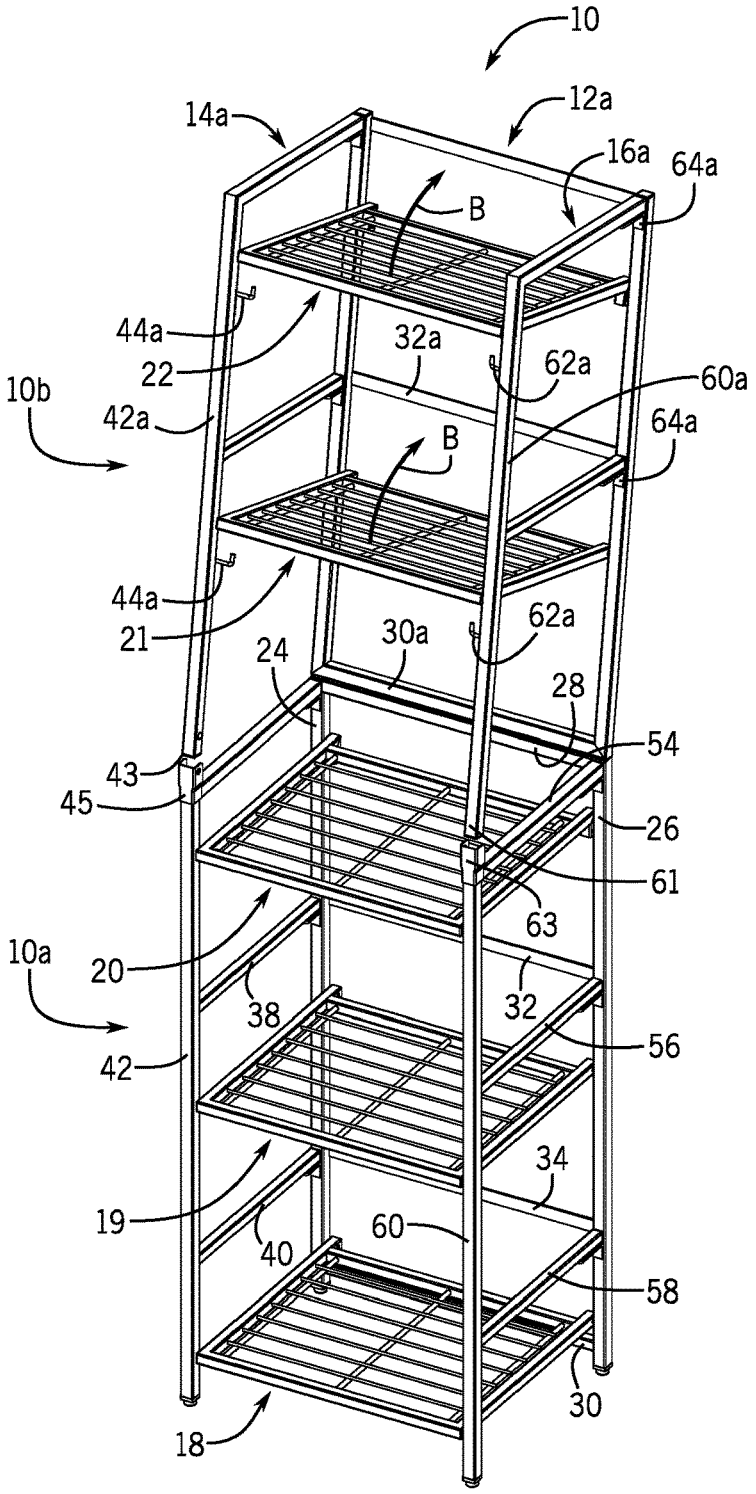
FIGS. 4-17 are sequential front perspective views of further stages of the shelving unit being folded towards the collapsed storage condition.

The lower left side support frame 14 has horizontal members 36, 38, 40, each of which has a forward end fixed to a lower vertical front member 42. A rear face of the lower vertical front member 42 provides a mounting surface to which a set of three spaced apart shelf-supporting hooks 44 (FIGS. 12 and 13) are fixed. The upper end of lower vertical front member 42 is provided with a tubular receiver 45 having a detent-receiving opening 45*a* (FIG. 3). Rearward ends of the horizontal members 36, 38, 40 respectively, are each pivotally mounted to the lower vertical member 24 of the lower rear support frame 12 by a first pivotal connection 46.

Figure 18:
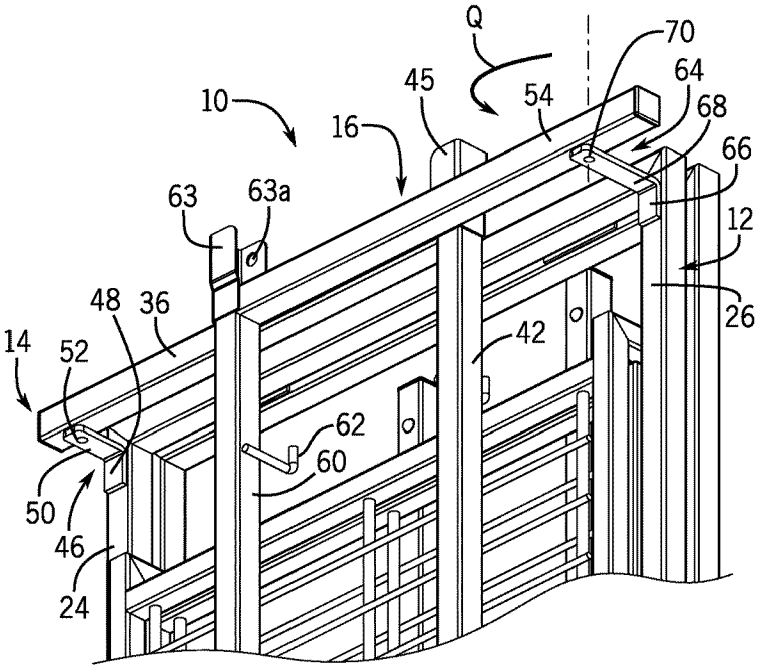
FIGS. 18 and 19 are perspective views of the shelving unit in the fully collapsed storage condition.
Figure 17:
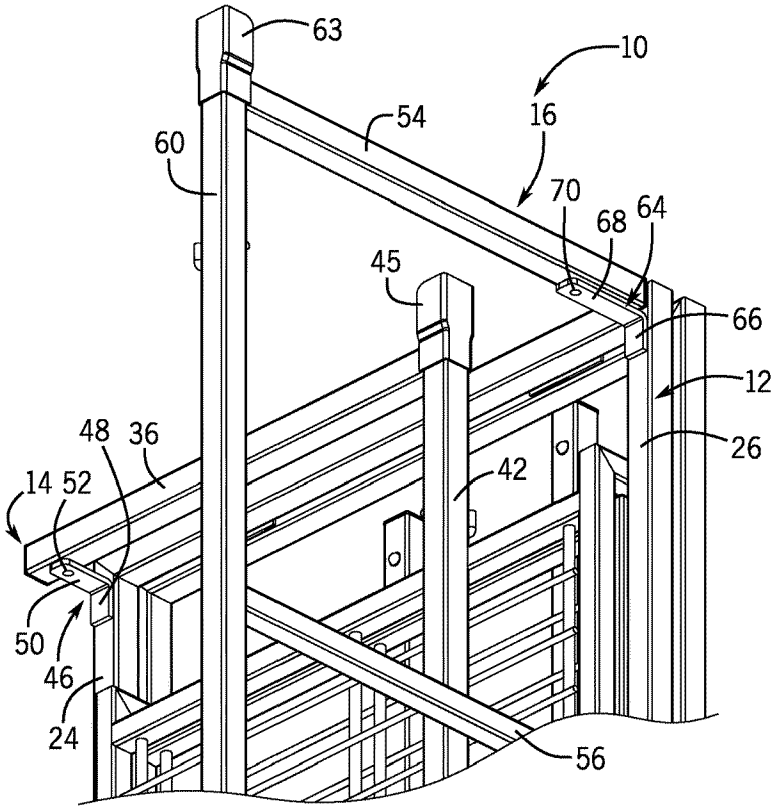
Figure 20:
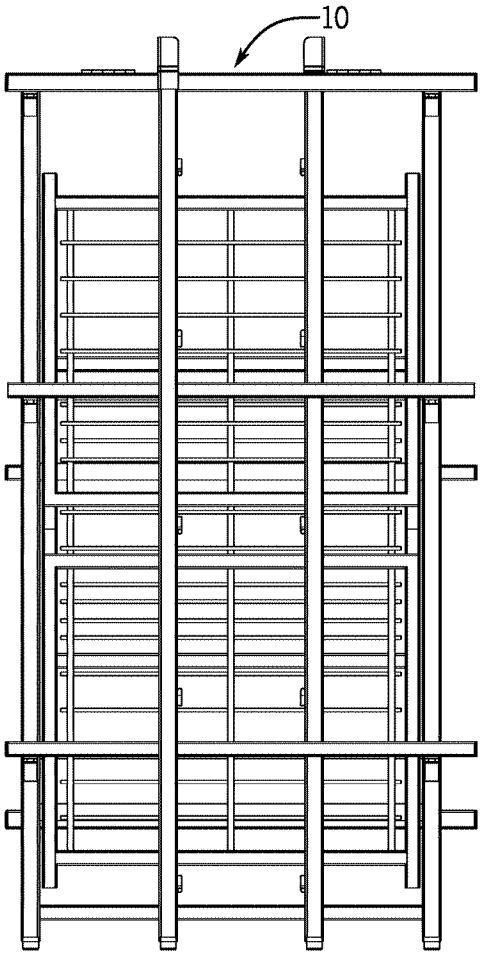
FIG. 20 is a front view of the shelving unit of FIG. 19 in the fully collapsed storage condition.
Figure 19:
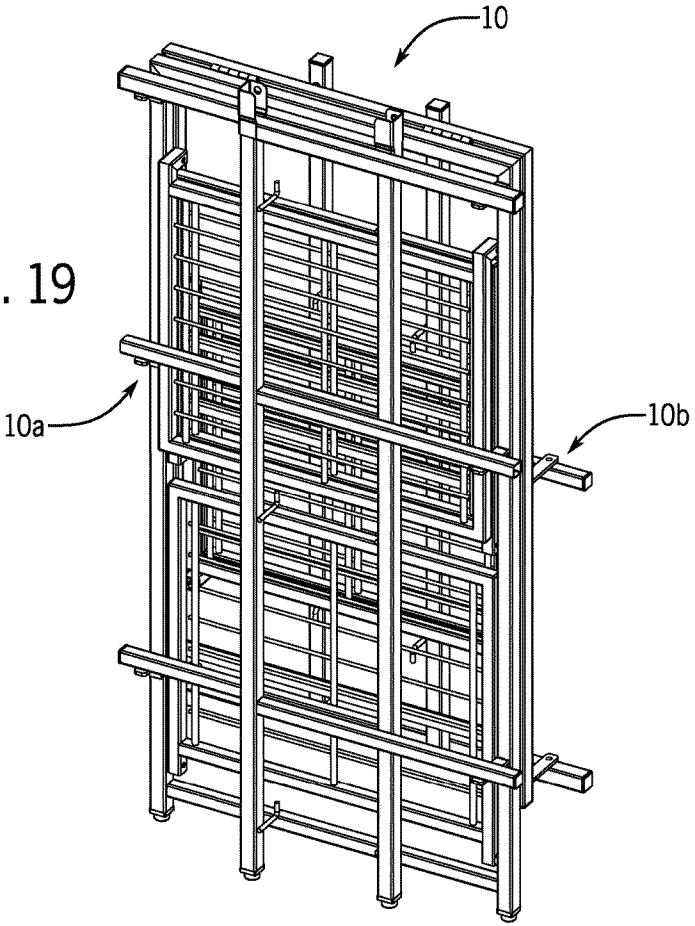

As best seen in FIGS. 17 and 18, each of the first pivotal connections 46 is defined by a rigid L-shaped bracket having a vertical leg 48 integrally joined to a forwardly extending horizontal leg 50. Each vertical leg 48 is fixed to a front surface of the lower vertical side member 24 beneath each of the horizontal members 36, 38, 40. Each horizontal leg 50 has an outer end which is attached by a pivot pin 52 to an underside of the horizontal members 36, 38, 40 at a location spaced slightly forwardly from a rearmost end of each of the horizontal members 36, 38, 40. The pivotal connections 46 enable the lower left side support frame 14 to be pivotally mounted about a vertical pivot axis to the lower vertical side member 24 of the lower rear support frame 12.

The lower right side support frame 16 has an upper horizontal member 54, an intermediate horizontal member 56 and a lower horizontal member 58, each of which has a forward end fixed to a lower vertical front member 60. A rear face of the lower vertical member 60 serves as a mounting surface to which three spaced apart inwardly and upwardly extending, shelf-supporting hooks 62 (FIGS. 12 and 13) are fixed. The upper end of the lower vertical front member 60 is provided with a tubular receiver 63 having a detent-receiving opening 63*a*. Rearward ends of the horizontal members 54, 56, 58 respectively, are each pivotally mounted to the lower vertical side member 26 by a second pivotal connection 64.

With further reference to FIGS. 17 and 18, each of the three second pivotal connections 64 is defined by a rigid L-shaped support bracket having a vertical leg 66 integrally joined to a forwardly extending horizontal leg 68. Each vertical leg 66 is fixed to a front surface of the lower vertical side member 26 beneath each of the horizontal members 54, 56, 58. Each horizontal leg 68 has an outer end which is attached by a pivot pin 70 to an underside of the horizontal members 54, 56, 58 at a location spaced slightly forwardly from the rearmost end of each of the horizontal members 54, 56, 58. The second pivotal connections 64 enable the lower right side support frame 16 to be pivotally mounted about a vertical pivot axis to the lower vertical side member 26.

As a unique feature of the present disclosure, the length of each of the horizontal legs 68 of the second pivotal connections 64 is longer than the length of each of the horizontal legs 50 of the first pivotal connections 46. The length differences of the horizontal legs 50, 68 permit the lower left side support frame 14 and the lower right side support frame 16 to be pivoted forwardly towards each other to a preferred compact, overlapping parallel arrangement which results during folding of the shelving unit 10 to the collapsed condition as will be described hereafter.

As seen in FIGS. 1 and 2, each of the shelves 18, 19, 20 has an identical construction, and includes a front rail 72, a rear rail 74 and opposed side rails 76, 78 which together form a rectangular shelf frame. Wire rods 80 extend between the front rail 72 and the rear rail 74, and wire members 82 extend transversely across and are connected to the wire member 82 to form a support surface. Rearward outer corners of the shelves 18, 19, 20 are pivotally mounted by a pair of shelf pivotal connections 84, such as provided on the opposed side of shelf 20 in FIG. 3 so that the shelves 18, 19, 20 each swing about a separate horizontal pivot axis. Each of the shelves 18, 19 is configured to pivot between a horizontal position (FIGS. 1 and 2) and a vertical raised position (e.g. FIG. 15). The shelf 20 is configured to pivot between a horizontal position (e.g. FIG. 1) and a vertical lowered position (e.g. FIG. 15). In the horizontal position shown in FIG. 1, the side frames 76, 78 of the shelves 18, 19 are supported by the hooks 44, 62 provided on the opposite front members 42, 60, respectively. In the vertical raised position, the shelves 18, 19 are sized to be completely received between the lower vertical side members 24, 26, and are prevented from travel rearwardly of the lower rear support frame 12 by the cross members 32, 34 thereof. In the vertical lowered position, the shelf 20 is positioned forwardly of and engaged against the raised shelf 19 in parallel relation therewith. The pivotal connections 84 provided on the shelves 18, 19, 20 are particularly configured with a frictional resistance so that each shelf 18, 19, 20 when pivoted will maintain its position and will not freefall by gravity when moved and released.

FIG. 1 illustrates the lower section 10*a* of the shelving unit 10 in the shelf-supporting condition such that the shelves 18, 19, 20 in their horizontal position are supported by the hooks 44, 62. The lower left side support frame 14 and the lower right side support frame 16 extend forwardly in substantial parallel relationship from the lower rear support frame 12 with the upper cross members 36, 54 being elevated above the top shelf 20. Engagement of the hooks 44, 62 with the shelves 18, 19, 20 normally prevents pivotal movement of the lower left and right side support frames 14, 16, respectively. Although not explicitly illustrated in the exemplary embodiment, the bottom ends of the lower vertical members 24, 26, 42, 60 maybe equipped with adjustable feet.

Turning now to the upper section 10*b* in FIGS. 1 and 2, the upper rear support frame 12*a* has a pair of opposing upper vertical side members 24*a*, 26*a*, respectively, and a set of horizontal upper cross members 28*a*, 30*a*, 32*a* extending between the upper vertical side members 24*a*, 26*a* to provide a rigid upper rear support structure. As seen in FIG. 3, the upper cross member 30*a* is movably connected by hinges 86 to the lower cross member 28 to enable pivoting of the upper section 10*b* relative to the lower section 10*a* about a horizontal pivot axis defined by a common hinge axis.

Figure 5:
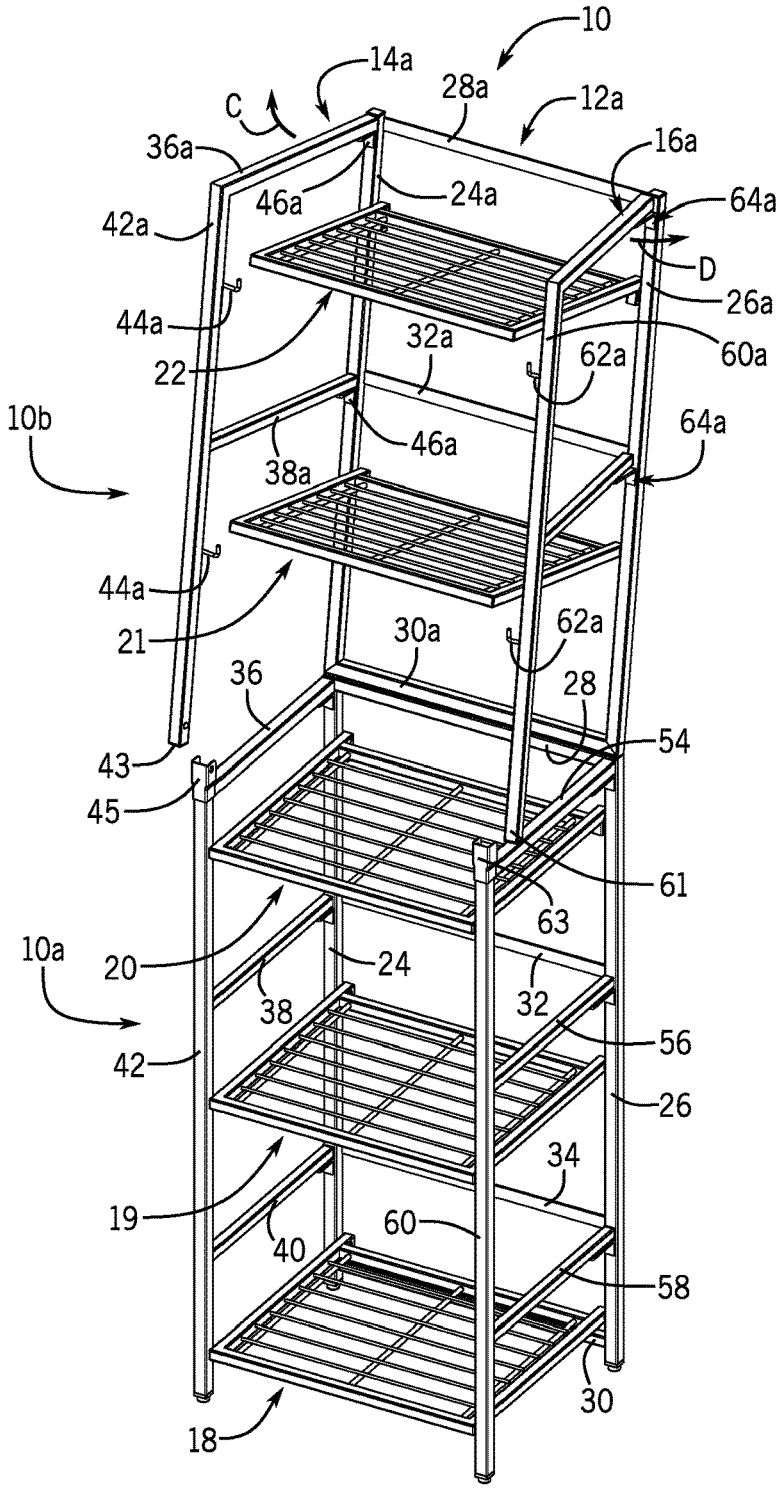
Figure 6:
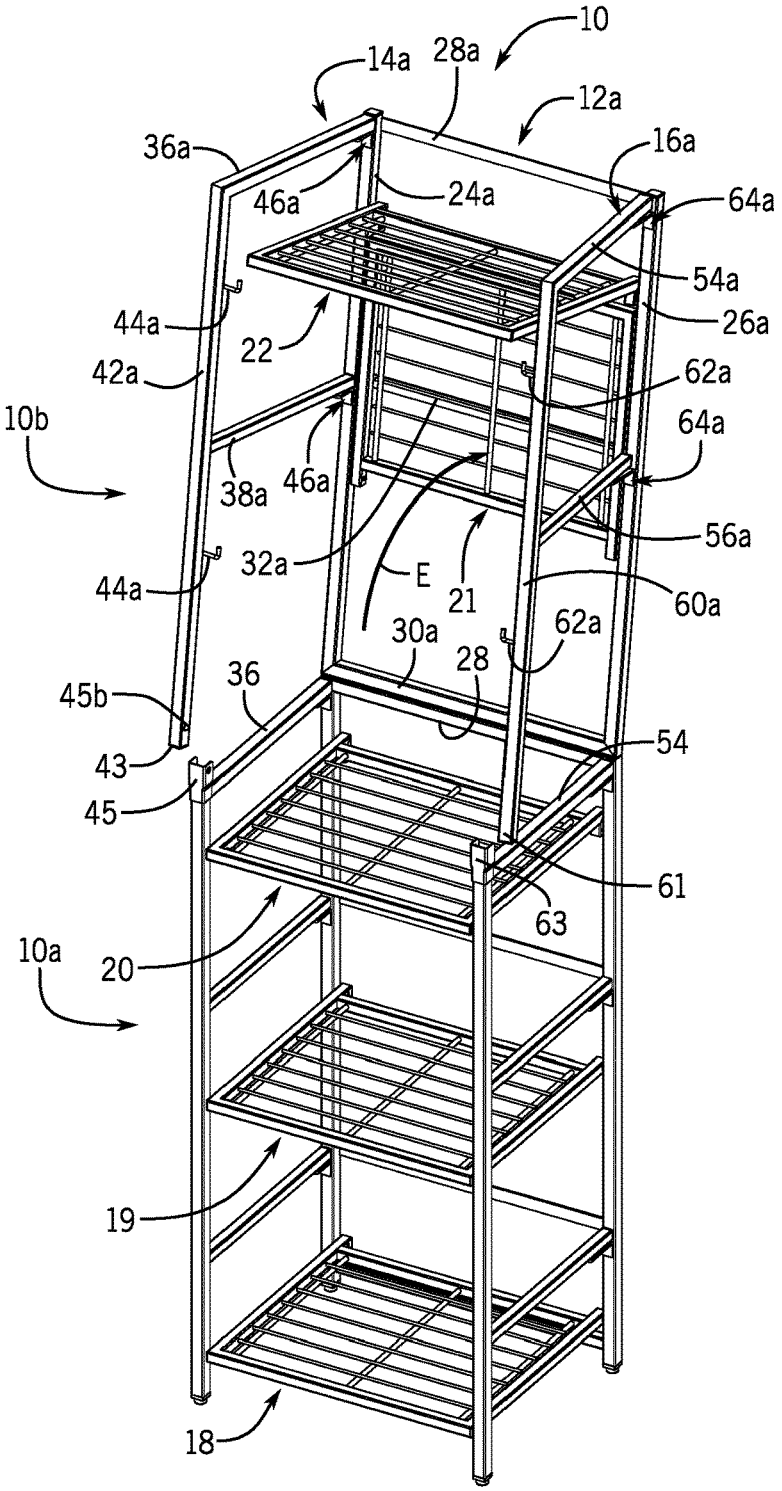
Figure 7:
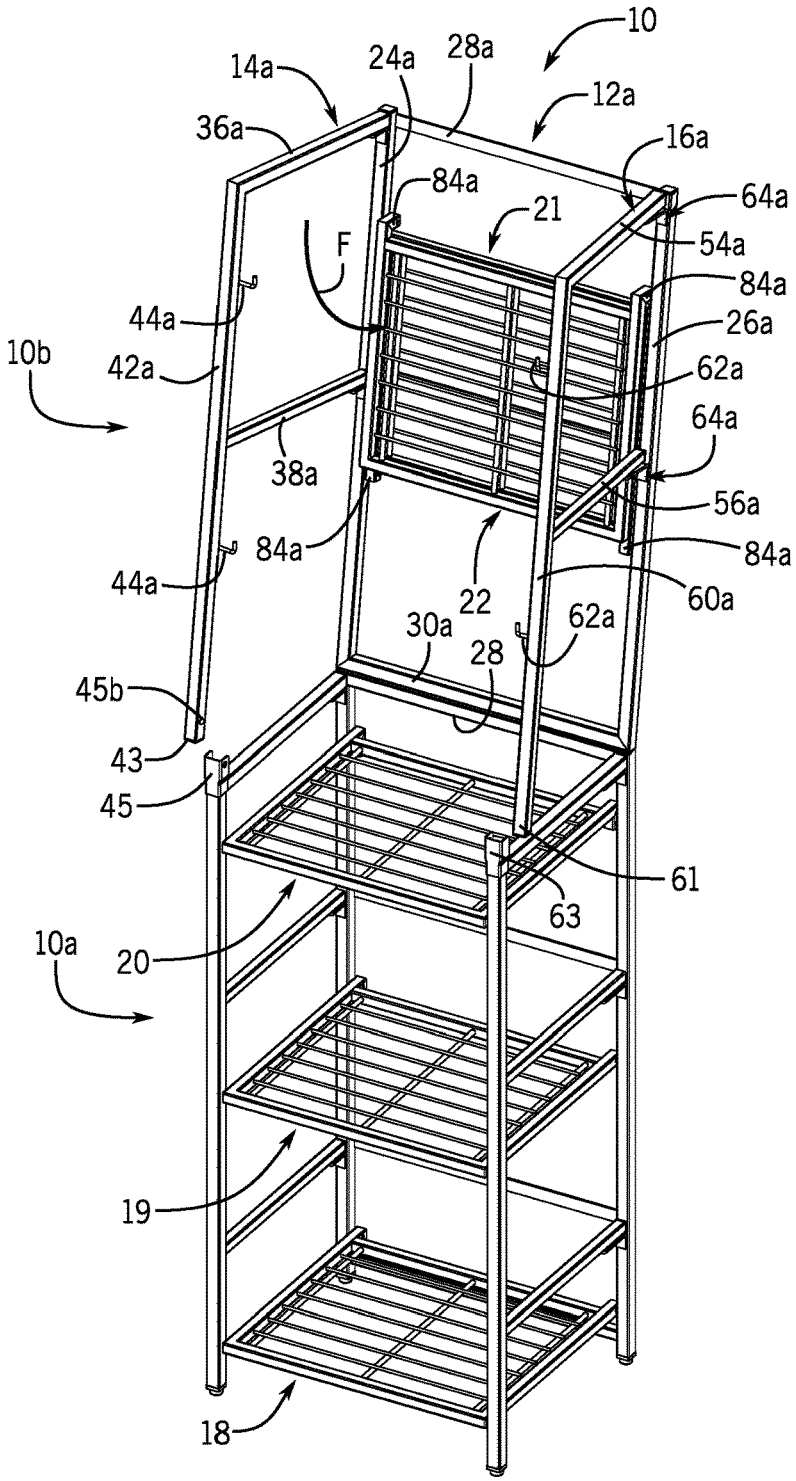
Figure 8:
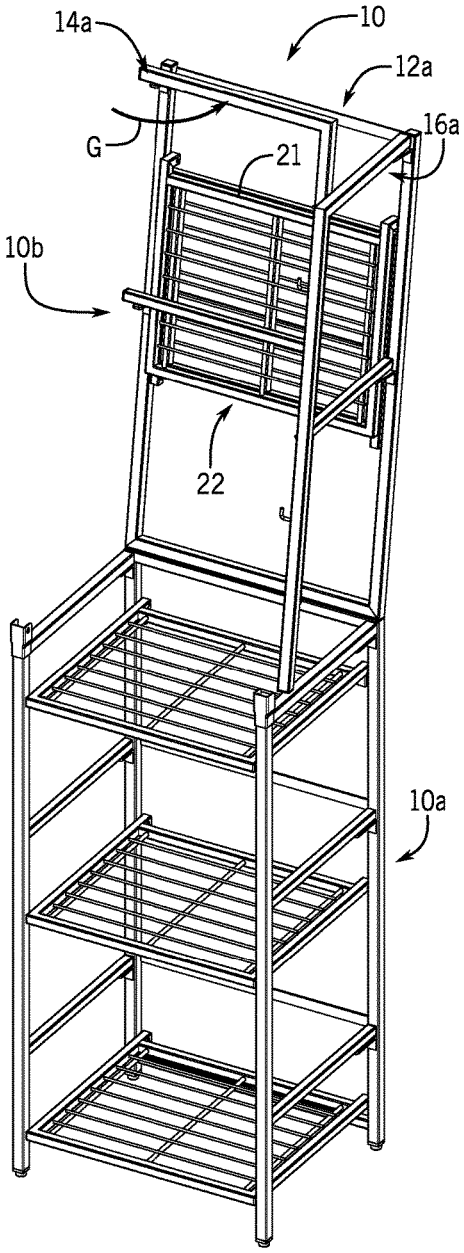
Figure 22:
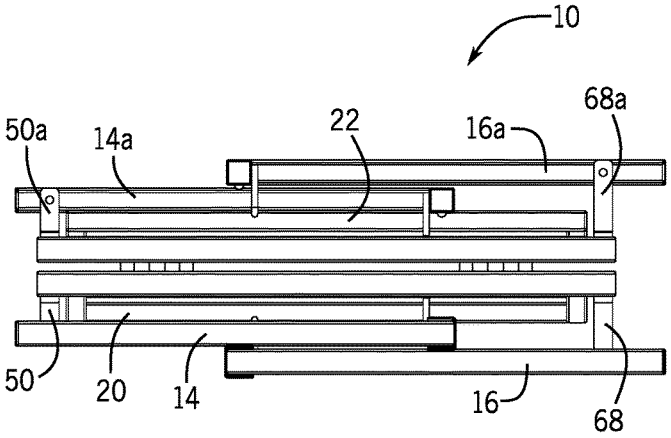
FIG. 22 is a top view of the shelving unit of FIG. 21 in the fully collapsed storage condition.

The upper left side support frame 14*a* has horizontal members 36*a*, 38*a*, each of which has a forward end fixed to an upper vertical front member 42*a*. A rear face of the upper vertical front member 42*a* provides a mounting surface to which a set of two spaced apart shelf-supporting hooks 44*a* (FIGS. 4 and 5) are fixed. A lower end 43 (FIG. 3) of upper vertical front member 42*a* is configured to be received and retained in the tubular receiver 45 on the lower vertical front member 42 on the lower section 10*a* by providing a detent 45*b* which is designed to snap into the opening 45*a* as the lower end 43 is moved into the tubular receiver 45. Rearward ends of the horizontal members 36*a*, 38*a*, respectively, are each pivotally mounted to the upper vertical member 24*a* of the upper rear support frame 12*a* by a third pivotal connection 46*a*, such as seen in FIG. 5. The third pivotal connection 46*a* is similar to the first pivotal connection 46, and includes a horizontal leg 50*a* as illustrated in FIG. 22. The third pivotal connection 46*a* enables the upper left side support frame 14*a* to be pivotally mounted about a vertical pivot axis to the upper vertical side member 24*a* of the upper rear support frame 12*a*.

The upper right support frame 16*a* has an upper horizontal member 54*a* and an intermediate horizontal member 56*a*, each of which has a forward end fixed to an upper vertical front member 60*a*. A rear face of the upper vertical front member 60*a* serves as a mounting surface to which a set of two spaced apart shelf-supporting hooks 62*a* (FIGS. 4 and 5) are fixed. A lower end 61 (FIG. 3) of upper vertical front member 60*a* is configured to be received and retained in the tubular receiver 63 on the lower vertical front member 60 on the lower section 10*a* by providing a detent 63*b* which is designed to snap into the opening 63*a* as the lower end 61 is moved into the tubular receiver 63. Rearward ends of the horizontal members 54*a*, 56*a*, respectively, are each pivotally mounted to the upper vertical member 26*a* of the upper rear support frame 12*a* by a fourth pivotal connection 64*a*, such as seen in FIG. 5. The fourth pivotal connection 64*a* is similar to the second pivotal connection 64, and includes a horizontal leg 60*a* as illustrated in FIG. 22. The fourth pivotal connections 64*a* enable the upper right side support frame 16*a* to be pivotally mounted about a vertical pivot axis to the upper vertical side member 26*a* of the upper rear support frame 12*a*.

Similar to the lower section 10*a*, the length of each of the legs 60*a* of the fourth pivotal connections 64*a* is longer than the length of the horizontal legs 50*a* of the third pivotal connections 46*a*. The length differences of the legs 50*a*, 68*a* permit the lower left side support frame 14*a* and the upper right side support frame 16*a* to be pivoted towards each other to a preferred compact, overlapping parallel arrangement which results during folding of the shelving unit to the collapsed condition as will be discussed below.

As seen in FIGS. 1 and 2, each of the shelves 21, 22 of the upper section 10*b* has an identical construction to shelves 18, 19, 20 on the lower section 10*a*. Rearward outer corners of the shelves 21, 22 are pivotally mounted by pivotal connections 84*a* (FIG. 7) so that the shelves 21, 22 swing about respective horizontal pivot axes. Shelf 21 is configured to pivot between a horizontal position (e.g. FIG. 1) and a vertical raised position (e.g. FIG. 6). The shelf 22 is configured to pivot between a horizontal position (e.g. FIG. 1) and a vertical lowered position (e.g. FIG. 7). In the horizontal position shown in FIG. 1, the shelves 21, 22 are supported by the hooks 44*a*, 62*a* provided on the opposed front members 42*a*, 60*a*, respectively. In the vertical raised position, the shelf 21 is sized to be completely received between the upper vertical side members 24*a*, 26*a*, and is prevented from travel rearwardly of the upper rear support frame 12*a* by the cross member 32*a*. In the vertical lowered position, the shelf 22 is positioned forwardly of and engaged against the raised shelf 21 in parallel relation therewith. The pivotal connections 84*a* on the shelves 21, 22 are particularly configured with a frictional resistance so that each shelf 21, 22 when pivoted will maintain its position and will not freefall by gravity when moved and released.

FIG. 1 illustrates the upper section 10*b* of the shelving unit 10 in a shelf-supporting condition such that shelves 21, 22 in their horizontal position are supported by the hooks 44*a*, 62*a*. The upper left side support frame 14*a* and the upper right side support frame 16*a* are supported upon the lower section 10*a* and extend forwardly in substantially parallel relationship from the upper rear support frame 12*a* with the upper cross members 28*a*, 36*a*, 54*a* being elevated above the top shelf 22. Engagement of the hooks 44*a*, 62*a* with the shelves 21, 22 normally prevents the pivotal movement of the upper left and right side support frames 14*a*, 16*a*, respectively. Lower ends 43, 61 of the upper vertical front members 42*a*, 60*a*, respectively are releasably retained in the tubular receivers 45, 63 on the lower vertical front members 42, 60, respectively.

When it is desired to convert the shelving unit 10 from a shelf-supporting condition to a collapsed condition, the lower ends 43, 61 are raised out of their frictional engagement with the tubular receivers 45, 63 so that the upper section 10*b* pivots slightly rearwardly about the hinges 86 (FIG. 3) in the direction of arrow A as shown in FIG. 2. Then, the shelves 21 and 22 are pivoted upwardly in the direction of arrows B in FIG. 4 so that the shelves 21 and 22 are disengaged from hooks 44*a*. 62*a*. Next, the upper left side support frame 14*a* is pivoted outwardly in the direction of arrow C followed by the upper right side support frame 16*a* being pivoted outwardly in the direction of arrow D as shown in FIG. 5. Pivoting of the left side and right side support frames 14*a*, 16*a* moves the hooks 44*a*, 62*a* outwardly to provide an obstruction free path through which shelf 21 is pivoted upwardly in the direction of arrow E in FIG. 6 in the vertical raised position in which the shelf 21 is completely received between the upper vertical side members 24*a*, 26*a*. Shelf 22 is then pivoted downwardly in the direction of arrow F to the vertical lowered position shown in FIG. 7 so that the shelf 22 lies parallel forwardly of and against the raised shelf 21.

Figure 9:
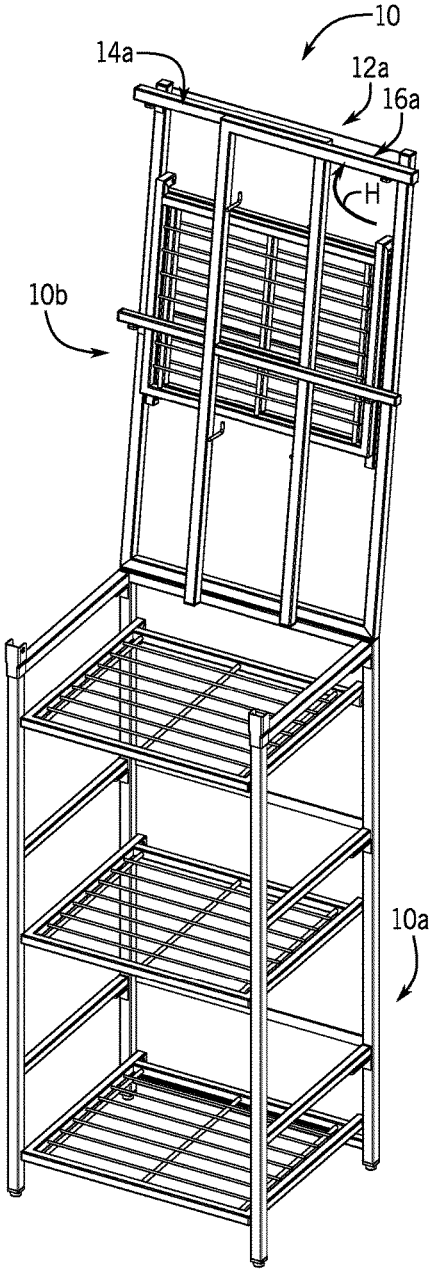
Figure 10:
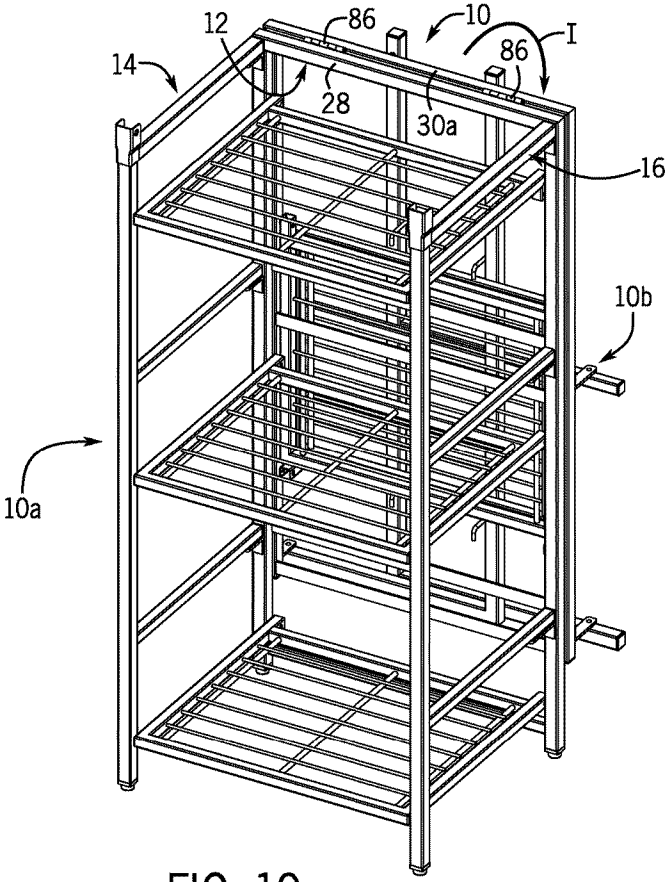
Figure 13:
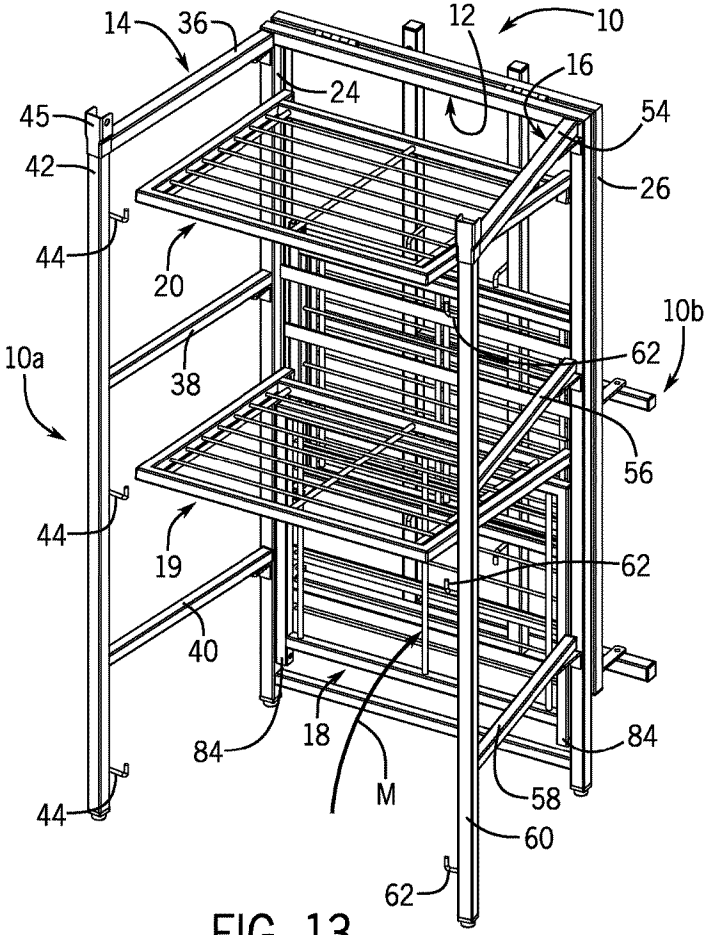

At this point, the upper left side support frame 14*a* is pivoted inwardly in the direction of arrow G so that it is parallel to the upper rear support frame 12*a*, and lies against and forwardly of the lower top shelf 22. The upper right side support frame 16*a* is pivoted inwardly in the direction of arrow H as shown in FIG. 9 so that it is substantially parallel to the upper rear support frame 12*a*, and lies against and forwardly of the folded upper left side support frame 14*a* to attain the collapsed condition of the upper section 10*b* of the shelving unit 10. As seen in FIG. 10, the collapsed upper section 10*b* is then flipped rearwardly via the hinges 86 in the direction of arrow I so that the collapsed upper section 10*b* lies behind and against the lower rear support frame 12.

Figure 11:
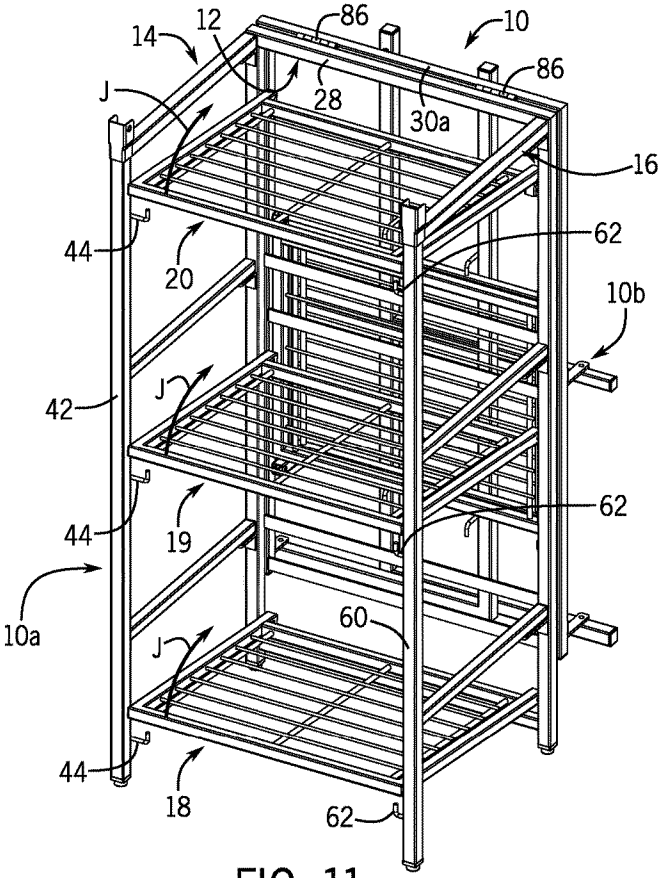
Figure 12:
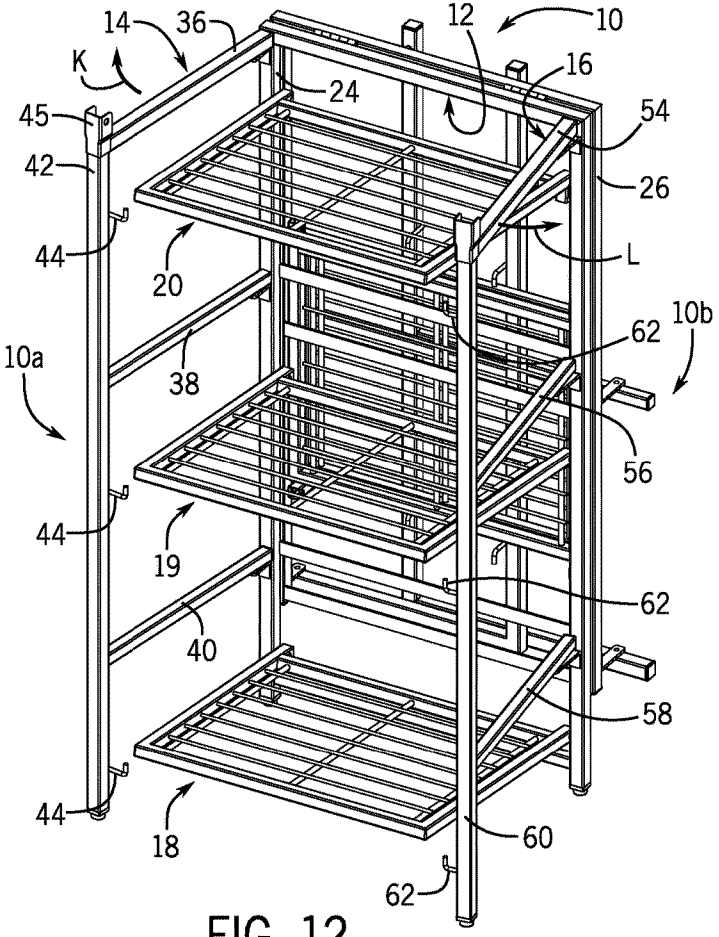
Figure 15:
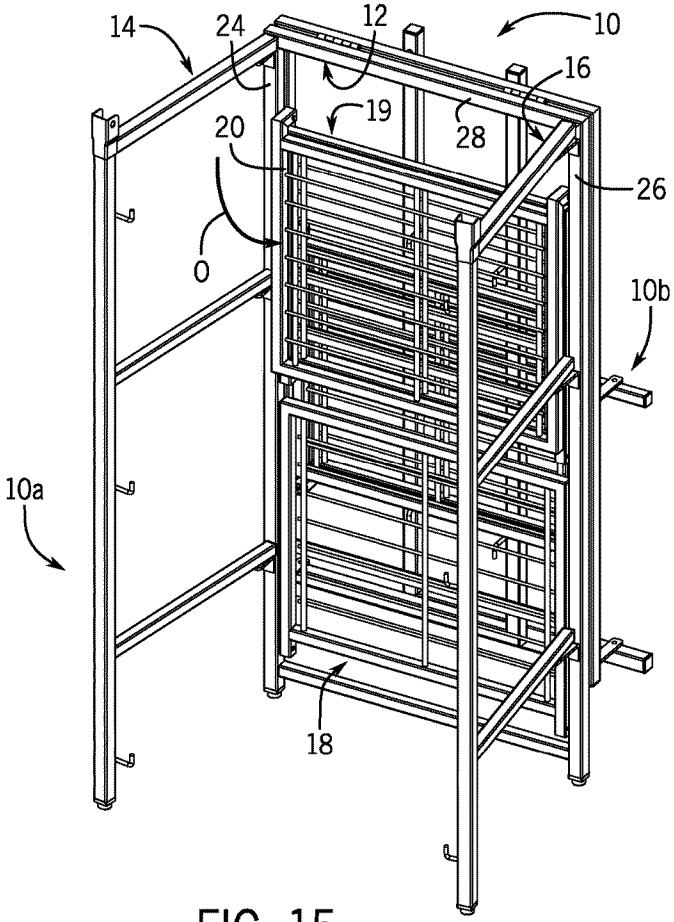
Figure 14:
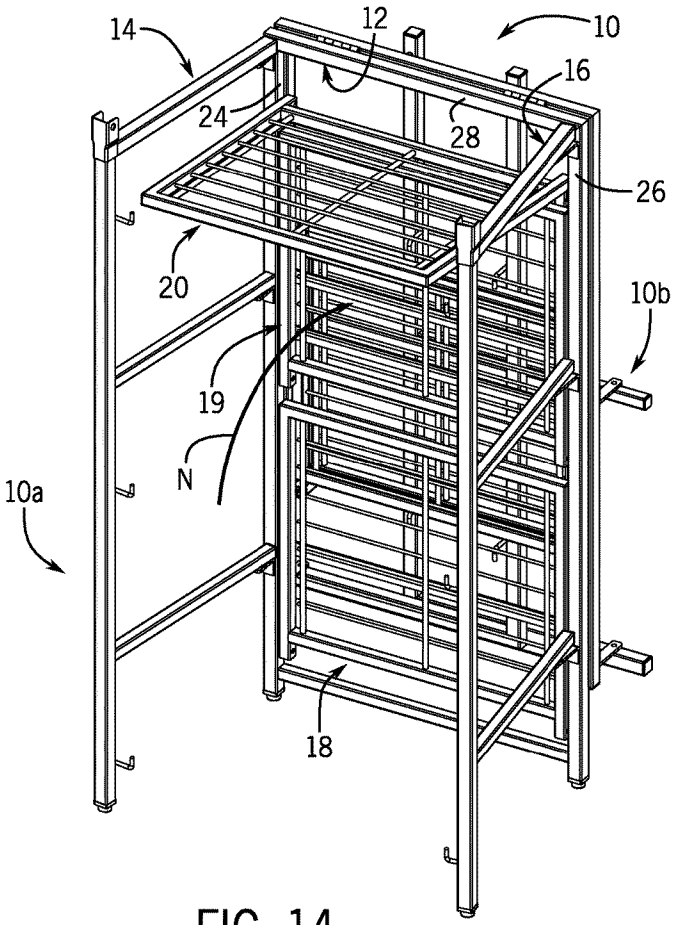

To initiate a collapse of the lower section 10*a* of the shelving unit 10, the shelves 18, 19, 20 are raised slightly in the direction of arrow J in FIG. 11 so that the shelves 18, 19, 20 are disengaged from the hooks 44, 62. Next, the lower left side support frame 14 is pivoted outwardly in the direction of arrow K followed by the lower side support frame 16 being pivoted outwardly in the direction of arrow L as shown in FIG. 12. Pivoting of the lower left side and right side support frames 14, 16 moves the hooks 44, 62 outwardly to provide an obstruction free path through which shelf 18 is pivoted upwardly in the direction of arrow M in FIG. 13 to the vertical raised position in which the shelf 18 is completely received between the lower vertical side members 24, 26. Shelf 19 is then pivoted upwardly in the direction of arrow N in the vertical raised position shown in FIG. 14 so that the shelf 19 lies completely between the lower vertical side members 24, 26, respectively, in alignment with and above the raised shelf 18. Shelf 20 is then pivoted downwardly in the direction of arrow O in FIG. 15 so that the shelf 20 lies parallel with, forwardly of and against the raised shelf 19.

Figure 16:
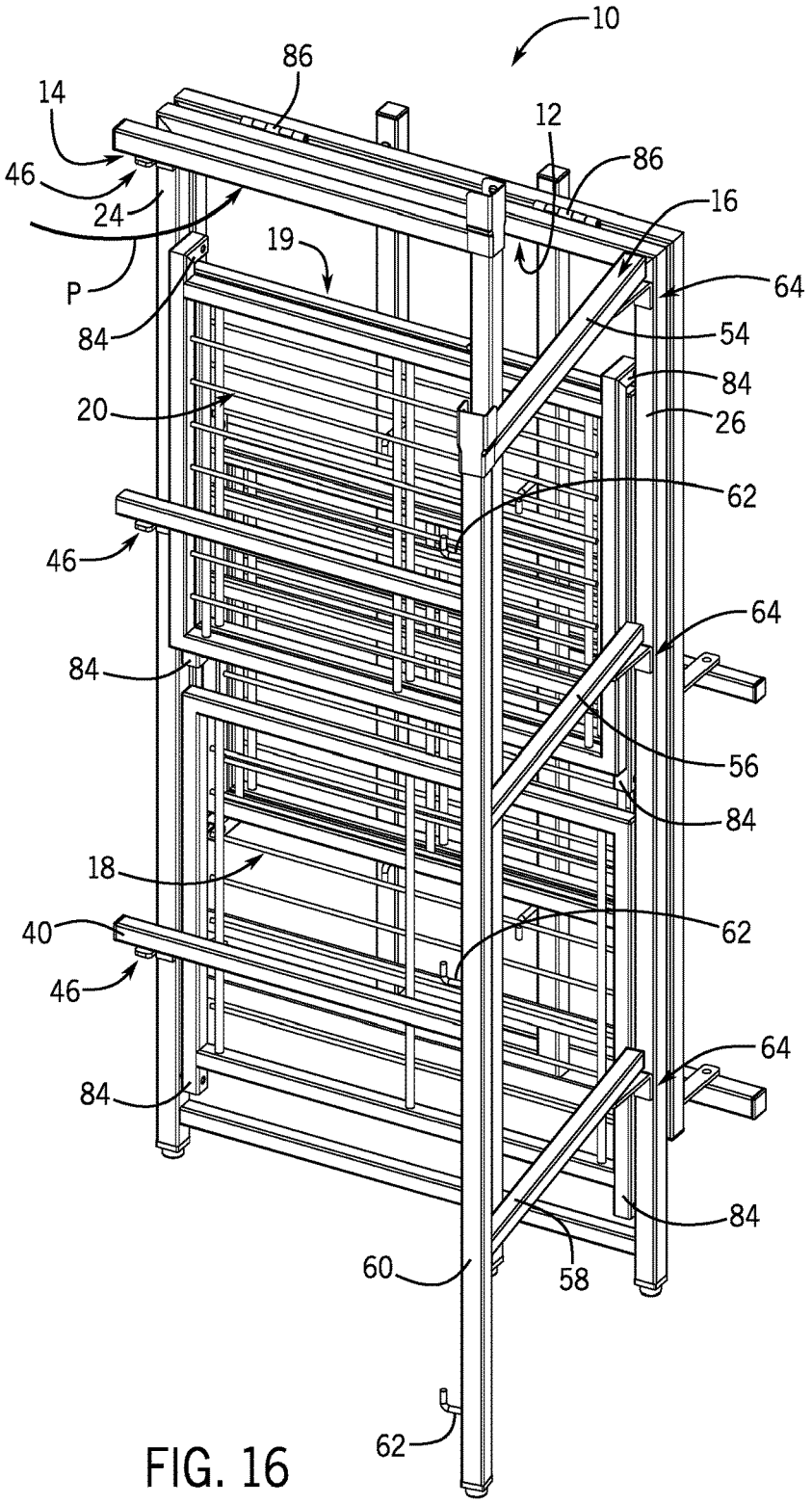

With the shelves 18, 19, 20 folded to vertical positions, the lower left side support frame 14 is pivoted inwardly in the direction of arrow P as shown in FIG. 16 so that it is parallel to the lower rear support frame 12, and lies against and forwardly of the folded shelves 18, 19, 20. The lower right side support frame 16 is pivoted inwardly in the direction of arrow Q in FIG. 18 so that it is also parallel to the lower support frame 12, and lies against and forwardly of the folding lower left side support frame 14 to attain the collapsed condition of the lower section 10*a* forwardly of the collapsed upper section 10*b* or the fully collapsed shelving unit 10 shown in FIGS. 19-22.

Figure 21:
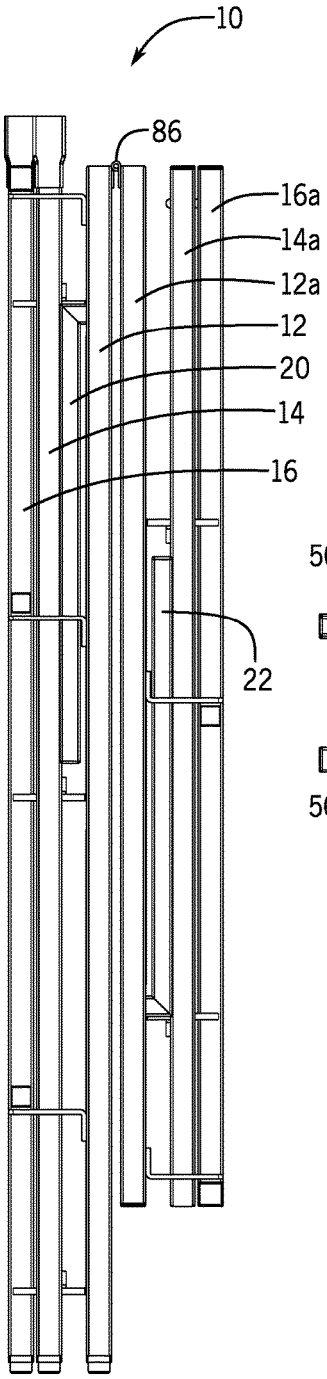
FIG. 21 is a right side view of the shelving unit of FIG. 20 in the fully collapsed storage condition.

As seen in FIGS. 21 and 22, the shelving unit 10 in the fully collapsed condition provides a compact, folded layered parallel arrangement of the lower right side support frame 16, the lower left side support frame 14, the shelf 20, the lower rear support frame 12, the upper rear support frame 12*a*, the shelf 22, the upper left side support frame 14*a* and the upper right side support frame 16*a*. The collapsed layered arrangement of this shelving unit 10 is made possible by sizing shelves 18 and 19 to fit between the lower vertical side members 24, 26, and the shelf 21 to fit between the upper vertical side members 24*a*, 26*a*, by placing the shelf 20 in parallel and flush against the shelf 19, by placing the shelf 22 in parallel and flush against the shelf 21 and by particularly configuring the horizontal legs 68, 68*a* of the pivotal connections 64, 64*a*, respectively, to be longer than the links of the horizontal legs 50, 50*a* of the pivotal connections 46, 46*a*, respectively so that the lower and upper support frames 14, 16, 14*a*, 16*a* and the lower and upper rear support frames 12, 12*a* are in parallel with each other. The present disclosure contemplates that left side support frames 14, 14*a* could be folded upon the right side support frames 16, 16*a* by making the length of the legs 50, 50*a* longer than the length of the legs 68, 68*a*. It should be understood that the hinges 86 provided between the lower section 10*a* and the upper section 10*b* enable a significant reduction in the height of the collapsed shelving unit 10 which is particularly advantageous during shipping or transport. It should also be appreciated that the shelving unit 10 can be quickly and conveniently set up in the shelf-supporting condition with several simple unfolding steps and without the need for using any tools or fasteners.

In the present disclosure, certain items have been used for brevity, clearness and understanding. No unnecessary limitations are to be implied therefrom beyond the requirement of the prior art because such terms are used for descriptive purposes only and are intended to be broadly construed. The different configurations, systems and method steps described herein maybe used alone or in combination with other configurations, systems and method steps. It is to be expected that various equivalents, alternatives and modifications are possible within the scope of the appended claims.

What is claimed is:

1. A shelving unit comprising:

a lower section movable between a first shelf-supporting condition and a first collapsed condition; and an upper section separately movable from the lower section between a second shelf-supporting condition and a second collapsed condition, wherein the upper section is movably connected to the lower section among a first mode mounted on top of and fully engaged with the lower section, a second mode partially disengaged from the lower section and a third mode located behind the lower section, the lower section having a lower rear support frame having a pair of lower vertical side members, first and second lower side support frames pivotally connected to the lower vertical side members of the lower rear support frame, at least one lower unit shelf pivotally mounted to the lower rear support frame for movement between a horizontal position supported upon the first and second lower side support frames, and a vertical position completely received between the lower vertical side members of the lower rear support frame, the upper section having an upper rear support frame having a pair of upper vertical side members, first and second upper side support frames pivotally mounted to the upper vertical side members of the upper rear support frame, at least one upper unit shelf pivotally mounted to the upper rear support frame for movement between a horizontal position supported upon the first and second upper side support frames, and a vertical position completely received between the upper vertical side members of the upper rear support frame, and wherein rear corners of the at least one lower and upper unit shelves are provided with a shelf pivotal connection arrangement configured with frictional resistance to maintain a position of the at least one lower and upper unit shelves during pivotal movement thereof between the horizontal position and the vertical position of the at least one lower and upper unit shelves.

2. The shelving unit of claim 1, wherein the upper section is pivotally connected to the lower section about a horizontal pivot axis.

3. The shelving unit of claim 1, wherein, in the first mode, the lower section is in the first shelf-supporting condition.

4. The shelving unit of claim 1, wherein, in the second mode, the upper section is in the second shelf-supporting condition.

5. The shelving unit of claim 1, wherein, in the second mode, the upper section is movable to the second collapsed condition.

6. The shelving unit of claim 1, wherein, in the third mode, the upper section is in the second collapsed condition.

7. The shelving unit of claim 1, wherein, in the third mode with the upper section in the second collapsed condition, the lower section is movable to the first collapsed condition such that the lower section and the upper section lie in parallel relationship with one another.

8. A shelving unit comprising:

a lower section having a lower rear support frame having a pair of lower vertical side members, and a set of horizontal members extending between the lower vertical side members;

a first lower side support frame pivotally connected to one of the lower vertical side members of the lower rear support frame;

a second lower side support frame pivotally connected to the other of the lower vertical side members of the lower rear support frame;

at least one lower unit shelf being pivotally mounted to the lower rear support frame for movement between a horizontal position supported upon the first and second lower side support frames, and a vertical position removed from the first and second lower side support frames, and completely received between the lower vertical side members of the lower rear support frame;

one of the first and second lower side support frames being pivoted between a first position extending forwardly from the lower rear support frame, and a second position folded parallel to the lower rear support frame and forwardly of the at least one lower unit shelf in the vertical position thereof;

the other of the first and second lower side support frames being pivoted between a first position extending forwardly from the lower rear support frame, and a second position folded parallel to the lower rear support frame, and forwardly of the one of the first and second lower side support frames in the second position thereof;

an upper section having an upper rear support frame having a pair of upper vertical side members, and a set of horizontal members extending between the upper vertical side members;

a first upper side support frame pivotally connected to one of the upper vertical side members of the upper rear support frame;

a second upper side support frame pivotally connected to the other of the upper vertical side members of the upper rear support frame;

at least one upper unit shelf being pivotally mounted to the upper rear support frame for movement between a horizontal position supported upon the first and second upper side support frames, and a vertical position removed from the first and second upper side support frames, and completely received between the upper vertical side members of the upper rear support frame;

one of the first and second upper side support frames being pivoted between a first position extending forwardly from the upper rear support frame, and a second position folded parallel to the upper rear support frame and forwardly of the at least one upper unit shelf in the vertical position thereof; and the other of the first and second upper side support frames being pivoted between a first position extending forwardly from the upper rear support frame, and a second position folded parallel to the upper rear support frame, and forwardly of the one of the first and second upper side support frames in the second position thereof, wherein the upper section is movably connected to the lower section among a first mode mounted on top of and fully engaged with the lower section, a second mode pivotally disengaged from the lower section and a third mode located behind the lower section, and wherein rear corners of the at least one lower unit and upper unit shelves are provided with a first pivotal connection arrangement configured with frictional resistance to continuously maintain a position of the at least one lower and upper unit shelves during pivotal movement thereof between the horizontal position and the vertical position of the at least one lower unit and upper unit shelves.

9. The shelving unit of claim 8, wherein, in the first and second modes, the first and second upper side support frames have upper vertical front members which are engageable and disengagable with lower vertical front members of the first and second lower support frames.

10. The shelving unit of claim 8, wherein, in the second mode, the other of the first and second upper side support frames is pivoted to the second position folded parallel to the upper rear support frame and forwardly of the first and second upper side support frames in the second position thereof.

11. The shelving unit of claim 8, wherein, in the third mode, the other of the first and second upper side support frames is pivoted to the second position folded parallel to the upper rear support frame and forwardly of the one of the first and second upper side support frames in the second position thereof.

12. The shelving unit of claim 8, wherein a hinge arrangement is provided between the upper rear support frame and the lower rear support frame and defines a horizontal pivot axis therebetween.

13. The shelving unit of claim 8, the first pivotal connection arrangement is configured to prevent freefall of the shelves during pivotal movement thereof.

14. The shelving unit of claim 8, wherein the first lower and upper side support frames are pivotally connected to the one of the lower and upper vertical side members by a second pivotal connection arrangement having first legs, and the second lower and upper side support frames are pivotally connected to the other of the lower and upper vertical side members by a third pivotal connection arrangement having second legs which are longer in length than the first legs.

15. The shelving unit of claim 8, wherein the at least one lower unit shelf includes a first shelf which, in a vertical position thereof, is completely received between the lower vertical side members of the lower rear support frame.

16. The shelving unit of claim 15, wherein the at least one lower unit shelf includes a second shelf which, in a vertical position thereof, is completely received between the lower vertical side members of the lower rear support frame.

17. The shelving unit of claim 16, wherein the at least one lower unit shelf includes a third shelf which, in a vertical position thereof, is folded downwardly and forwardly of the lower rear support frame.

18. The shelving unit of claim 17, wherein the at least upper unit shelf includes a fourth shelf which, in a vertical position thereof, is completely received between the upper vertical side members of the upper rear support frame.

19. The shelving unit of claim 18, wherein the at least one upper unit shelf includes a fifth shelf which, in a vertical position thereof, is folded downwardly and forwardly of the upper rear support frame.

20. A method of moving a shelving unit between a shelf-supporting condition and a collapsed storage condition, the method comprising the steps of:

(a) providing a lower section having a lower rear support frame having a pair of lower vertical side members, and a set of horizontal members extending between the lower vertical side members;

a first lower side support frame pivotally connected to one of the lower vertical side members of the lower rear support frame, and provided with a first shelf-supporting structure on a first lower front vertical member;

a second lower side support frame pivotally connected to the other of the lower vertical side members of the lower rear support frame, and provided with a second shelf-supporting structure on a second lower front vertical member;

a first shelf pivotally mounted between the lower vertical side members for movement between a horizontal position supported on the first and second shelf-supporting structure, and a vertical position removed from the first and second shelf-supporting structure and completely received between the lower vertical side members;

a second shelf pivotally mounted between the lower vertical side members for movement between a horizontal position supported on the first and second shelf-supporting structure above the first shelf in the horizontal position thereof, and a vertical position removed from the first and second shelf-supporting structure, and completely received between the lower vertical side members; and a third shelf pivotally connected between the lower vertical side members for movement between a horizontal position supported on the first and second shelf-supporting structure above the second shelf in the horizontal position thereof, and a vertical position removed from the first and second shelf-supporting structure, and positioned forwardly of and against the second shelf in the vertical position thereof;

(b) providing an upper section having an upper rear support frame having a pair of upper vertical side members, and a set of horizontal members extending between the upper vertical side members;

a first upper side support frame pivotally connected to one of the upper vertical side members of the upper rear support frame, and provided with a third shelf-supporting structure on a first upper front vertical member;

a second upper side support frame pivotally connected to the other of the upper vertical side members of the upper rear support frame, and provided with a fourth shelf-supporting structure on a second upper front vertical member;

a fourth shelf pivotally mounted between the upper vertical side members for movement between a horizontal position supported on the third and fourth shelf-supporting structure, and a vertical position removed from the third and fourth shelf-supporting structure and completely received between the upper vertical members; and a fifth shelf pivotally connected between the upper vertical side members for movement between a horizontal position supported on the third and fourth shelf-supporting structure above the fourth shelf in the horizontal position thereof, and a vertical position removed from the third and fourth shelf-supporting structure, and positioned forwardly of and against the fourth shelf in the vertical position thereof, wherein the upper rear support frame is pivotally connected about a horizontal axis to the lower rear support frame, wherein the first and second upper front vertical members are releasably engaged with the first and second lower front vertical members, and wherein with the first, second, third, fourth and fifth shelves in the horizontal position, the shelving unit defines the shelf-supporting condition;

(c) disengaging the first and second upper front vertical members from the first and second lower front vertical members while pivoting the upper rear support frame on the lower rear support frame;

(d) removing the fourth and fifth shelves from the third and fourth shelf-supporting structure;

(e) pivoting the first and second upper side support frames outwardly of the upper rear support frame;

(f) pivoting the fourth shelf upwardly to the vertical position completely between the upper vertical side members;

(g) pivoting the fifth shelf downwardly to the vertical position forwardly of the fourth shelf in the vertical position thereof;

(h) pivoting one of the first and second upper side support frames from a first position extending forwardly of the upper rear support frame to a second position folded parallel to the upper rear support frame and lying forwardly of the fifth shelf in the vertical position thereof;

(i) pivoting the other of the first and second upper side support frames from a first position extending forwardly of the upper rear support frame to a second position folded parallel to the upper rear support frame and lying forwardly of the one of the first and second upper side support frames in the second position thereof to define a collapsed upper section;

(j) pivoting the collapsed upper section behind the lower rear support frame;

(k) removing the first, second and third shelves from the first and second shelf-supporting structure;

(l) pivoting the first and second lower side support frames outwardly of the lower rear support frame;

(m) pivoting the first shelf upwardly to the vertical position completely between the lower vertical side members;

(n) pivoting the second shelf upwardly to the vertical position completely between the lower vertical side members and above the first shelf in the vertical position thereof;

(o) pivoting the third shelf downwardly to the vertical position forwardly of and against the second shelf in the vertical position thereof;

(p) pivoting one of the first and second lower side support frames from the first position extending forwardly of the lower rear support frame to a second position folded parallel to the lower rear support frame and lying forwardly of the third shelf in the vertical position thereof; and (q) pivoting the other of the first and second lower side support frames from the first position extending forwardly of the lower rear support frame to a second position folded parallel to the lower rear support frame and lying forwardly of the one of the first and second lower side support frames in the second position thereof to define a collapsed lower section, wherein rear corners of the first, second, third, fourth and fifth shelves are provided with a shelf pivotal connection arrangement configured with frictional resistance to prevent free fall and to continuously maintain a position of the first, second, third, fourth and fifth shelves during pivotal movement thereof between the horizontal and vertical positions, and wherein the shelving unit is converted from the shelf-supporting condition to the collapsed storage condition in which the first and second lower side support frames, the third shelf, the first and second upper side support frames and the fifth shelf sequentially form a compact folded layered parallel arrangement with one another.

* * * * *